United States Patent [19]

Forsyth

[11] 4,010,603

[45] Mar. 8, 1977

[54] TIME MARKING CHRONOMETER

[75] Inventor: Eric B. Forsyth, Brookhaven, N.Y.

[73] Assignee: Ensign Electronics, Inc., Brookhaven, N.Y.

[22] Filed: Apr. 30, 1975

[21] Appl. No.: 573,313

[52] U.S. Cl. ..... 58/39.5; 58/50 R

[51] Int. Cl.[2] ..... G04F 10/04; G04B 19/00

[58] Field of Search ..... 58/39.5, 50 R, 74, 145 R

[56] References Cited

UNITED STATES PATENTS

| | | | |
|---|---|---|---|
| 3,715,881 | 2/1973 | Girard | 58/50 R |
| 3,765,163 | 10/1973 | Levine | 58/50 R |
| 3,854,277 | 12/1974 | Samejima | 58/39.5 |
| 3,962,861 | 6/1976 | Protta | 58/39.5 |

*Primary Examiner*—E. S. Jackmon
*Attorney, Agent, or Firm*—Martin Fruitman

[57] ABSTRACT

A fully electronic chronometer using a quartz crystal as a frequency standard and displaying mean time by the use of electronically operated digital read-outs. The circuit permits the display of the instant of time at which a switch is operated, while mean time continues to be counted by the circuitry. Other features include conservation of power by display of mean time only upon demand and the provision for control and display remote from the timing circuitry.

12 Claims, 3 Drawing Figures

TIME MARKING CHRONOMETER

BACKGROUND OF THE INVENTION

This invention relates generally to chronometers and specifically to electronically-operated chronometers with electronic display.

Electronic time keeping circuitry lends itself naturally to the high accuracy requirements of chronometers for navigational purposes. However, despite the proliferation of electronic timepieces available, no apparatus is available to fill the specific need of the navigator. For celestial navigation, the navigator is required to note with particular accuracy the time at which he takes a reading on the position of heavenly bodies. This marking of the time is conventionally done by quickly looking from the sextant to the chronometer and estimating the time required to make the shift or by audibly indicating to a second person, who is already looking at the chronometer, the exact instant of the sextant reading. Another technique used, which is also common in automobile rallys, is to start a stop watch in synchronism with the chronometer and then to stop the stop watch at the moment of interest and to later calculate the exact time of the moment of interest. These methods of noting the time of an event are both cumbersome and subject to error.

The use of present electronic chronometers adds no benefit for the navigator since his potential error in reading the chronometer is much greater than the inherent error of the chronometer. The typical electronic chronometer or timepiece takes the form of a stable source of high frequency oscillations. While some such timepieces use as a signal source the 60Hz waveform present as domestic power, this source is not very stable, is subject to interruption, and is unavailable where many timing functions are required. In portable versions, not operated by a main electricity supply, but rather from batteries, the source of the signal is usually a quartz crystal or timing fork maintained in a state of constant oscillation. The frequency of the signal is then divided or reduced by electronic counters to produce a stable low frequency signal suitable for read-out of the chronometer.

At the present time, the majority of battery-operated chronometers do not utilize electronic digial read-outs, such as light emitting diodes, due to an unacceptably low battery life. A timepiece used as a navigational chronometer, to display mean time, must have a battery life of at least several months. In order to achieve this, most crystal controlled battery operated chronometers do not use a digital display but instead, use a conventional analog-type, using hands to show hours, minutes, and seconds. This type of device, although extremely accurate as a timepiece, yields little actual improvement in accuracy since the human error involved in reading still remains.

It is, therefore, the object of the present invention to enable a user to mark the time of the event while observing the event, with no need to observe the timepiece at that instant.

It is also the object of the invention to provide a portable electronic chronometer with suitably low battery drain to permit long battery life which also has digital display to prevent human error in reading the time.

It is a further object of the invention to provide a portable electronic chronometer in which the display of time may be arrested at a particular instant while the time keeping continues to function with no loss in accuracy.

Still another object of the invention is to provide a portable electronic chronometer in which the display of mean time may be restored at will.

SUMMARY OF THE INVENTION

The foregoing and other objects are attainable in the present invention by providing a circuit which provides a train of pulses with a precise repetition rate of the order of the desired time resolution required for the measurement. For navigational purposes, the repetition rate of one pulse per second yields an accuracy comparable to other factors involved, such as the navigator's response times, but it is important that this repetition rate be extremely accurate, that it not cause variations of more than several seconds per year. This accuracy is accomplished by use of a crystal oscillator and pulse divider chain, means well known to those skilled in the art.

The highly accurate pulse train is processed by three counters in succession to yield information on seconds, minutes, and hours. This information is fed to a gate circuit with sufficient channels to accomodate all the information available from the seconds, minutes, and hours counters. The gate circuit, when appropriately driven, is capable of either inhibiting or passing the information to a register which stores the counts passed to it. A decoder and display unit is attached to the register output in order to convert the signal to digital display form. The digital display devices are independently powered, so that the display operates independently of the rest of the circuit and may be deenergised when not being viewed, in order to conserve battery power. It is thus possible to either operate the digital display or to leave it inoperative and also to either pass the timing information to the display or isolate the timing information from the display.

Suitable digital logic circuitry is included which, upon operation of the "Mark" control by the operator, drives the gate circuit for a short period of time sufficient to load the contents of the seconds, minutes, and hours times at the instant the control was activated into the register, and to activate the decoder and display for a time period of approximately 1 minute to enable the operator to view the display of time. The display viewed under this mode of operation is a single time designation, corresponding to the time the "Mark" control was operated, and no further progression of time is shown on the display during the viewed period.

Another mode of operation which is made available by digital logic circuitry is that of convention timekeeping which, upon activation of the "Read" control, drives both the gate circuit and the decoder and display circuit for approximately one minute. The display viewed under this operation is that of a normally progressing clock. The circuit may also be arranged so that the display is only activated for as long as the "Read" control is activated.

The invention also includes means for setting the timers to a predetermined time so that the timing function may be started in exact synchronism with mean time.

BRIEF DESCRIPTION OF THE INVENTION

FIG. 1 is a circuit diagram, in block form, illustrating the invention using high power consumption display devices, FIG. 2 is a perspective view of the preferred embodiment of the invention using low power consumption display devices, FIG. 3 is a cicuit diagram, in block form, illustrating the invention using display devices of low power consumption.

DETAILED DESCRIPTION OF THE INVENTION

Figure 1:
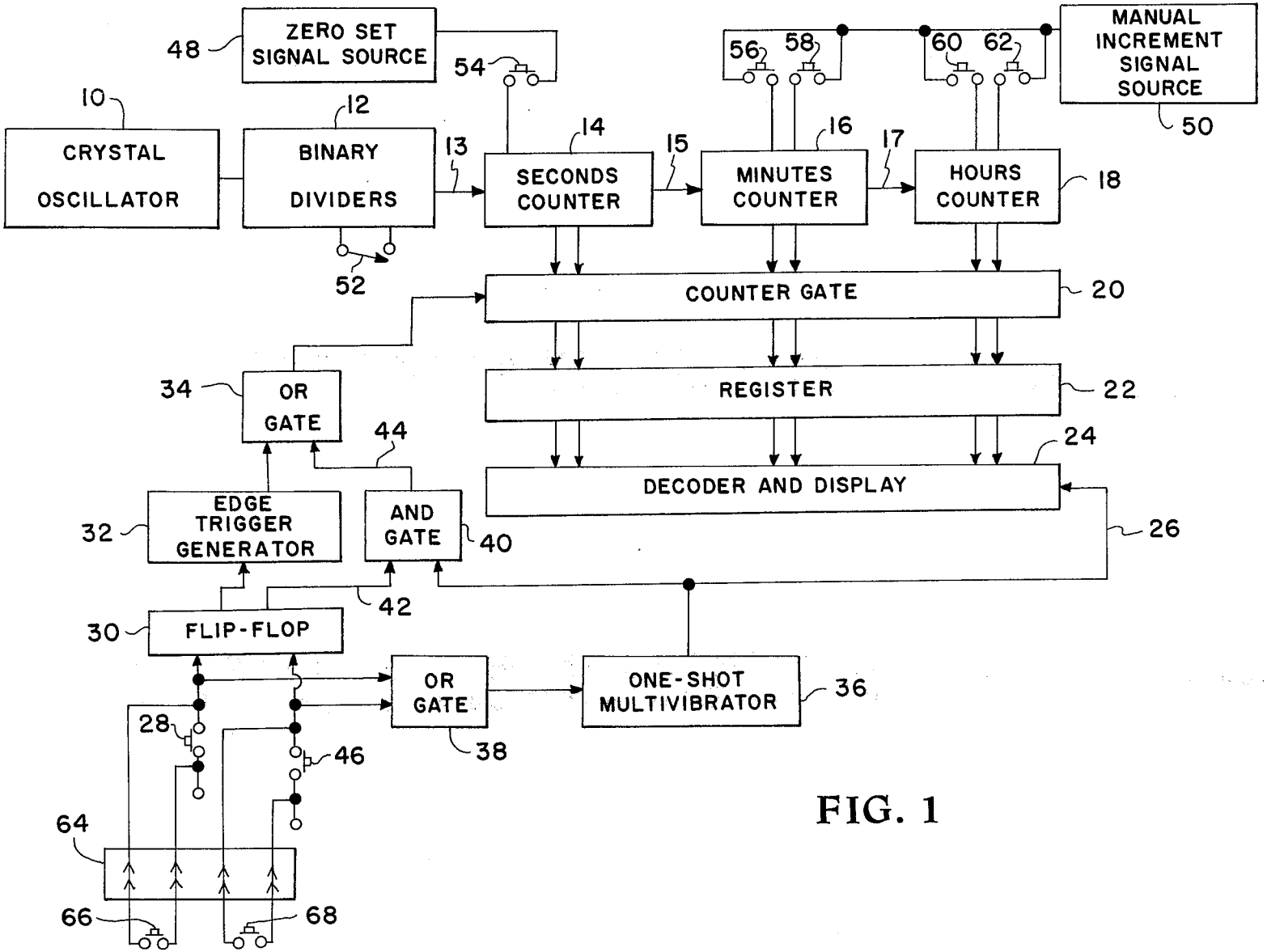

One embodiment of the invention selected for illustration is shown in block circuit diagram form in FIG. 1. The circuit shown in FIG. 1 includes crystal oscillator 10 which generates a highly stable and accurate high frequency pulse train. This pulse train is processed by binary divider 12 to furnish a one pulse per second repetition rate on line 13. This pulse train operates seconds counter 14 which divides the pulse rate by 60 and then sends a pulse to minutes counter 16 on line 15. Minutes counter 16 also divides by 60 and in turn sends a pulse to hours counter 18 on line 17. Each of the counters is designed to recycle at the appropriate number so that seconds counter 14 and minutes counter 16 count to 59 before returning to zero while hours counter 18 may be designed to count either to 12 or 24 whichever is most desireable. If 12 is chosen as a factor a fourth counter can be added to designate AM or PM.

Seconds counter 14, minutes counter 16, and hours counter 18 all feed their count information to counter gate 20 which, depending upon its state of operation, will either inhibit the count signal or pass the count signal to register 22. Register 22 acts to store the information presented to it so that if counter gate 20 inhibits the counter information, the last count received by register 22 remains indefinitely. Decoder and display 24 converts the information stored in register 22 to digital information in conventional hours, minutes, and seconds form and displays the information when properly driven by a signal on line 26.

Counter gate 20 is set so that it normally inhibits the passage of counter information to register 22. However, when Mark switch 28 is momentarily activated, it sets flip-flop 30 causing edge trigger generator 32 to generate a momentary signal through OR gate 34 and thus drive counter gate 20 to cause the counter time information to be loaded into register 22. Since edge trigger generator 32 operates only momentarily, only a single reading of time, that instantaneous time at which Mark switch 28 is activated, is loaded into register 22. Another arrangement for securing a single time reading would be to substitute a simple toggle switch set in one of two stable conditions for Mark switch 28 and flip-flop 30. This simplified version would serve as well if no remote control were desired.

Mark switch 28 also sets one-shot 36 via OR gate 38. One-shot 36 generates a signal to place a display drive voltage on line 26 for an approximate time duration of 1 minute. Such a length of time is sufficient to permit the viewer to properly record the reading of time.

The signal generated by one-shot 36 is also fed to AND gate 40 along with the complimentary output of flip-flop 30 fed to AND gate 40 on line 42. This causes the output of AND gate 40, which is fed to OR gate 34 on line 44, to prevent any further activation of Mark switch 28 from loading any subsequent time information into register 22 during the one-minute display viewing time.

To accomplish a more conventional reading of time, in which the viewer watches time accumulate on the display, Read Time and Reset switch 46 is momentarily activated. This operates one-shot multivibrator 36 through OR gate 38 causing the display to operate for the 1 minute interval. Read Time and Reset switch 46 also resets flip-flop 30 causing AND gate 40 and OR gate 34 to furnish proper drive signal to counter gate 20. Display 24 therefore shows time continuously during the one minute interval.

Read Time and Reset switch 46 is also used to convert from an instantaneous time reading being held on the display to an accumulating time reading and then back to a second instantaneous reading by the subsequent activation of Mark time switch 28.

Initial synchronization of the chronometer with mean time is accomplished by the use of zero set signal source 48 and manual increment signal source 50. The timing pulses are interrupted at binary divider 12 by operation of Run-Stop switch 52 and the display is operated by use of Read Time and Reset switch 46. Seconds counter 14 is then reset to zero by momentarily attaching zero reset signal source 48 through switch 54. Minutes counter 16 and hours counter 18 are each incremented one digit at a time by the use of switches 56, 58, 60, and 62 until a desired time setting has been reached. The timing signal is then reestablished at the exact instant at which mean time corresponds to the setting of the counters.

In order to permit the option of operating the chronometer with only a small control switch in the hands of the operator, connector 64 is available with connections to enable duplicating the functions of switches 28 and 46 with external switches 66 and 68.

Figure 2:
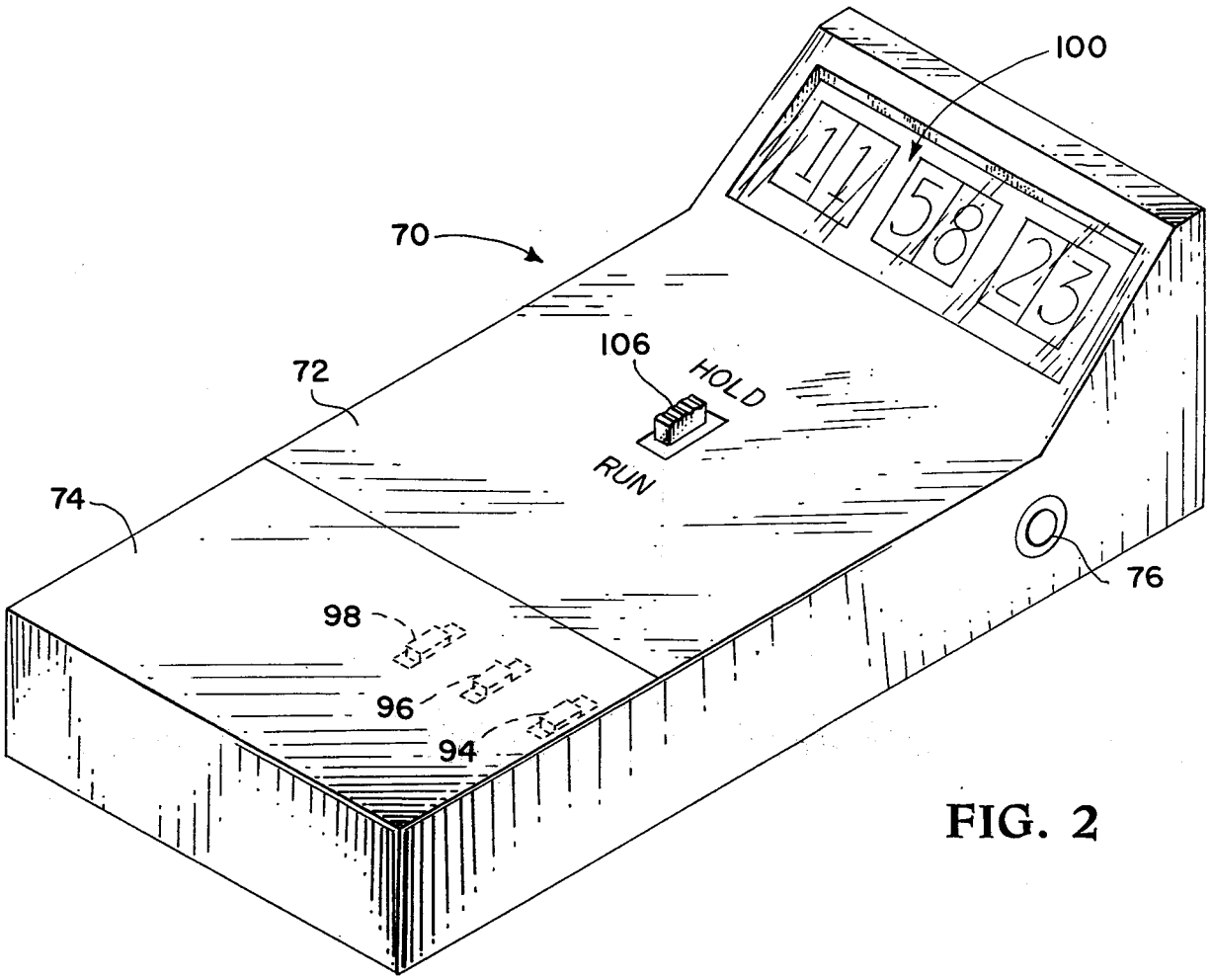
Figure 3:
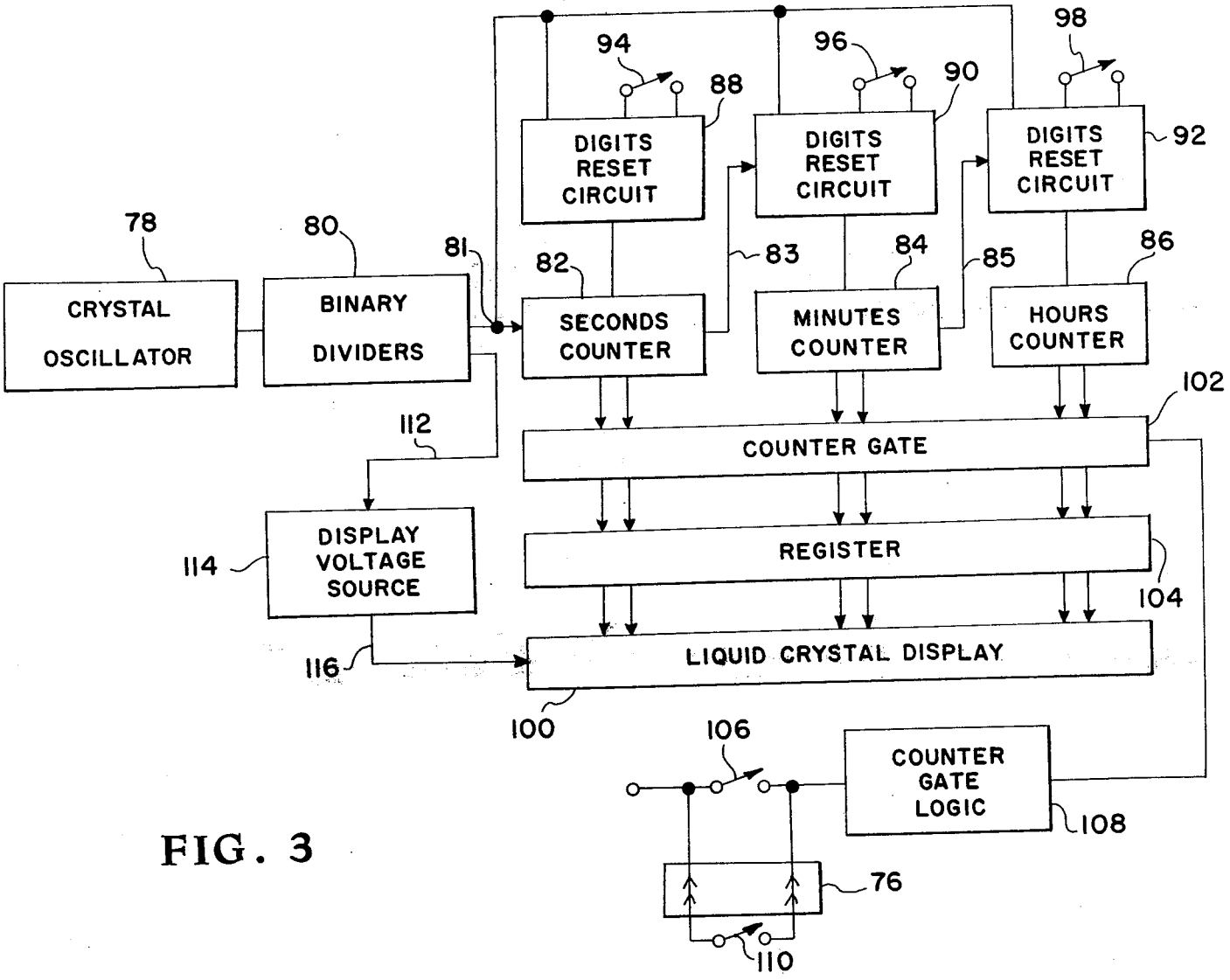

FIG. 2 shows a physical representation of another embodiment of the invention which is also shown in FIG. 3 in block circuit diagram form. This embodiment is particularly desireable for low power consumption display devices, such as liquid crystal displays. However, it should be understood that the physical representation of FIG. 2 would only include minor variations if it showed the embodiment previously described in reference to FIG. 1. Such variations would include an increase of the number of control switches on top surface 72 and within access cover 74, and a change in the configuration of remote control connector 76.

As shown in FIG. 2 and FIG. 3, the liquid crystal display embodiment 70 contains many circuit elements which function identically to the high power consumption display embodiment shown in FIG. 1.

A highly stable and accurate pulse train generated by crystal oscillator 78 is processed by binary dividers 80 to furnish the one pulse per second repetition rate on line 81 which drives seconds counter 82. The circuit for passing the output to minutes counter 84 and hours counter 86 shown in FIG. 3 differs from the previously described system and is not limited to the low power display embodiment, but could be used in any chronometer. Line 81 is here connected to each of three digits reset circuits 88, 90, and 92 whose outputs are connected to seconds counter 82, minutes counter 84, and hours counter 86. By the use of control switches 94, 96, and 98 the logic of reset circuits 88, 90, and 92 is controlled to select either the normal input available from the previous counter output on lines 83 and 85 or the one pulse per second available from line 81. Switches 94, 96, and 98 are thus capable of advancing the displays at a rate of one count per second as opposed to the method described previously which increments the displays one digit for every time the switches are operated. This feature is used, as previously described, for initial synchronization of the chronometer with mean time.

The output of counters 82, 84, and 86 is fed to the liquid crystal display 100 through counter gate 102 and register 104. Since display 100 consumes so little power, it operates continuously. The only control required is "Hold-Run" switch 106 which, by controlling counter gate logic circuit 108, blocks counter gate 102 and holds the display upon the liquid crystals but, as in the previous circuit, does not interfere with the counting circuits. Returning switch 106 to the "Run" position unlocks counter gate 102 and display 100 begins indicating the actual time count again. The function of "Hold-Run" switch 106 may be duplicated by external switch 110 connected through remote control connector 76.

Another advantage of the low power consumption display is that it permits the power for the display to be secured from the binary divider 80. As shown in FIG. 3, line 112 is connected to a pulse output of binary divider 80 which powers display voltage source 114. With a particular configuration of divider, line 112 could, for instance, carry 32 Hz signal. Such an arrangement eliminates the need for a special voltage source for the displays.

It is to be understood that the forms of the invention herein shown are merely preferred embodiments. Various changes may be made in the shape, size, or arrangements of parts; equivalent means may be substituted for those illustrated and described and certain features may be used independently from other features without departing from the spirit and scope of the invention. For example, timing sources other than crystal oscillators may be used, or, a greater or lesser number of counters may be used, with different dividers or with a repetition rate different than one second, depending upon the time resolution desired. Moreover, the length of display time or reset time with the high power consumption display may be varied to meet the needs of the particular application. Also the number of decoders and drivers can be reduced by multiplexing, wherein one decoder and display drive operates all digits in a serial manner at a frequency greater than can be detected by the eye. The number of registers can also be reduced by the use of up-down counters during the hold period. All such embodiments deal with counting and display techniques well known to those skilled in the art and do not change the essential features of the invention.

What is claimed as new and desired to be secured by Letters Patent of the United States is:

1. An improved chronometer for measuring mean time with electronically operated digital displays comprising:

timekeeping section producing real time information in the form of hours, minutes and seconds;

gate means connected to said timekeeping section independently controlling the transfer of real time information from the timekeeping section to the digital displays whereby an individual real time reading may be retained upon the digital displays while the timekeeping operation continues uninterrupted with no loss of the reference to real time;

logic means connected to and controlling said gate means for inhibiting further transfer of time information to indicate the exact instant of real time at which a phenomenon takes place and including blocking means for preventing a subsequent attempt to retain a new time reading on the displays from superceding a first time reading; and reset means connected to and controlling said logic means for reestablishing the transfer of time information to the displays after such transfer has been inhibited.

2. An improved chronometer for measuring mean time with electronically operated digital displays as in claim 1 further comprising drive means connected to and capable of independently energizing and deenergizing the digital displays.

3. An improved chronometer for measuring mean time with electronically operated digital displays as in claim 2 further comprising timing means connected to said drive means for limiting the time for which the digital displays remain energized whereby power consumption of the chronometer is reduced.

4. An improved chronometer for measuring mean time with electronically operated digital displays as in claim 2 wherein the drive means, when momentarily activated, drives the digital displays for only a predetermined interval of time, whereby power consumption of the chronometer is reduced.

5. An improved chronometer for measuring mean time with electronically operated digital displays as in claim 2 further comprising means for simultaneously energizing the digital displays and reestablishing the transfer of time information to the digital displays.

6. An improved chronometer for measuring mean time with electronically operated digital displays as in claim 1 wherein the gate means is arranged to inhibit the transfer of time information except when the logic means requires the transfer of time information to the displays.

7. An improved chronometer for measuring mean time with electronically operated digital displays as in claim 6 wherein the logic means comprises:

a momentarily activated Mark switch;

a flip-flop circuit, connected to said Mark switch, which is set by the operation of said Mark switch;

an edge trigger generator, connected to the output of said flip-flop circuit, which generates a momentary signal upon the actuation of said Mark switch;

a first OR gate connected to the output of said edge trigger generator which drives the gate means momentarily, whereby only an individual time reading is transfered to the displays;

a second OR gate connected to said Mark switch;

a one-shot multivibrator connected to the output of said second OR gate, said multivibrator operating for a predetermined interval of time;

an AND gate connected to the output of said one-shot multivibrator and also to the complimentary output of said flip-flop circuit and whose output is connected to a second input of said first OR gate whereby the action of said first OR gate is blocked should said Mark switch be operated inadvertently during the predetermined time interval, thereby protecting the time reading on the displays from being accidently lost; and said reset means comprising a momentarily activated reset switch connected to the reset line of said flip-flop circuit which upon activation cancels the blocking action of said AND gate and permits operation of said Mark switch to transfer another individual time reading.

8. An improved chronometer for measuring mean time with electronically operated digital displays as in claim 7 wherein said one-shot multivibrator is also connected to and energizes the digital display for the predetermined interval of time and wherein said reset switch is also connected to another input of said second OR gate whereby the activation of said reset switch not only permits the transfer of a new time reading but also begins transfer of time information to the display and activates the display for the predetermined interval of time.

9. An improved chronometer for measuring mean time with electronically operated digital displays as in claim 1 further comprising means for stopping and starting the timekeeping operation and means for manually incrementing the display whereby the timekeeping operation may be precisely synchronized with mean time.

10. An improved chronometer for measuring mean time with electronically operated digital displays as in claim 1 further comprising means for stopping and starting the timekeeping operation and means for driving each counter with a faster repetition rate pulse, to increment the display whereby the timekeeping operation may be precisely synchronized with mean time.

11. An improved chronometer for measuring mean time with electronically operated digital displays as in claim 1 wherein the power for the digital displays is generated from a pulse train available within the timekeeping section of the chronometer.

12. An improved chronometer for measuring mean time with electronically operated digital displays as in claim 1 wherein said logic means contains provision for control external to the chronometer.

* * * * *